US010692514B2

(12) United States Patent
Christoph

(10) Patent No.: US 10,692,514 B2
(45) Date of Patent: Jun. 23, 2020

(54) SINGLE CHANNEL NOISE REDUCTION

(71) Applicant: HARMAN BECKER AUTOMOTIVE SYSTEMS GMBH, Karlsbad-Ittersbach (DE)

(72) Inventor: Markus Christoph, Straubing (DE)

(73) Assignee: Harman Becker Automotive Systems GmbH, Karlsbad-Ittersbach (DE)

( * ) Notice: Subject to any disclaimer, the term of this patent is extended or adjusted under 35 U.S.C. 154(b) by 0 days.

(21) Appl. No.: 16/045,670

(22) Filed: Jul. 25, 2018

(65) Prior Publication Data

US 2019/0035416 A1 Jan. 31, 2019

(30) Foreign Application Priority Data

Jul. 27, 2017 (EP) ..... 17183509

(51) Int. Cl.

| | |
|---|---|
| ***G10L 21/0208*** | (2013.01) |
| ***H04R 3/00*** | (2006.01) |
| ***G10L 21/0232*** | (2013.01) |
| *G10L 21/0216* | (2013.01) |

(52) U.S. Cl.

CPC ..... *G10L 21/0208* (2013.01); *G10L 21/0232* (2013.01); *H04R 3/005* (2013.01); *G10L 2021/02082* (2013.01); *G10L 2021/02166* (2013.01); *H04R 2430/20* (2013.01)

(58) Field of Classification Search

CPC ..... G10K 11/175; G10L 21/0208; G10L 21/0232; G10L 2021/02082; G10L 2021/02166; H04R 3/005; H04R 2430/20

USPC ..... 381/73.1, 94.2, 94.3

See application file for complete search history.

(56) References Cited

U.S. PATENT DOCUMENTS

| | | | | |
|---|---|---|---|---|
| 8,184,801 | B1 * | 5/2012 | Hamalainen | H04M 9/08 379/406.03 |
| 8,280,730 | B2 * | 10/2012 | Song | G10L 21/0208 379/406.01 |
| 2006/0270467 | A1 * | 11/2006 | Song | G10L 21/0208 455/570 |
| 2012/0239392 | A1 * | 9/2012 | Mauger | G10L 21/0216 704/226 |
| 2018/0277135 | A1 * | 9/2018 | Ali | G10L 25/51 |

* cited by examiner

*Primary Examiner* — William A Jerez Lora

(74) *Attorney, Agent, or Firm* — Artegis Law Group, LLP

(57) ABSTRACT

One embodiment id directed towards a noise reduction system that includes a detector block that is configured to detect noise components in an input signal based on a signal-to-noise ratio spectrum of the input signal. The noise reduction system also includes a masking block operatively coupled with the detector block and configured to generate a final spectral noise removal mask and to apply the final spectral noise removal mask to the input signal if noise components in the input signal are detected, the final spectral noise removal mask being configured to suppress the noise components in the input signal, when applied.

13 Claims, 5 Drawing Sheets

SINGLE CHANNEL NOISE REDUCTION

CROSS-REFERENCE TO RELATED APPLICATIONS

This application claims priority to the co-pending European patent application titled, "SINGLE CHANNEL NOISE REDUCTION," filed on Jul. 27, 2017 and having Serial No. EP 17 183 509.3. The subject matter of this related application is hereby incorporated herein by reference

BACKGROUND

Technical Field

The disclosure relates to a single channel noise reduction system and method and computer-readable medium that includes instructions for carrying out the method (also referred to herein as a "system").

Description of the Related Art

Systems for far field sound capturing, also referred to as far field microphones or far field microphone systems, are adapted to record sounds from a desired sound source that is positioned at a greater distance (e.g., several meters) from the far field microphone. The greater the distance between sound source and the far field microphone, the lower the desired sound to noise ratio is. The term "noise" in the instant case includes sound that carries no information, ideas or emotions, e.g., no speech or music. If the noise is undesired, it is also referred to as noise. When speech or music is introduced into a noise-filled environment such as a vehicle, home or office interior, the noise present in the interior can have an undesired interfering effect on a desired speech communication or music presentation. Noise reduction is commonly the attenuation of undesired signals but may also include the amplification of desired signals. Desired signals may be speech signals, whereas undesired signals can be any sounds in the environment which interfere with the desired signals. There have been three main approaches used in connection with noise reduction: Directional beamforming, spectral subtraction, and pitch-based speech enhancement. Systems designed to receive spatially propagating signals often encounter the presence of interference signals. If the desired signal and interferers occupy the same temporal frequency band, then temporal filtering cannot be used to separate the desired signal from the interferer. It is desired to improve noise reduction systems and methods.

SUMMARY

A noise reduction system includes a detector block configured to detect noise components in an input signal based on a signal-to-noise ratio spectrum of the input signal; and a masking block operatively coupled with the detector block and configured to generate a final spectral noise removal mask and to apply the final spectral noise removal mask to the input signal if noise components in the input signal are detected, the final spectral noise removal mask being configured to suppress the noise components in the input signal, when applied.

A noise reduction method includes detecting noise components in an input signal based on a signal-to-noise ratio spectrum of the input signal; and generating a final spectral noise removal mask and applying the final spectral noise removal mask to the input signal if noise components in the input signal are detected, the final spectral noise removal mask being configured to suppress the noise components in the input signal, when applied.

Other systems, methods, features and advantages will be, or will become, apparent to one with skill in the art upon examination of the following detailed description and appended figures. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. In the Figures, like referenced numerals designate corresponding parts throughout the different views.

Figure 1:
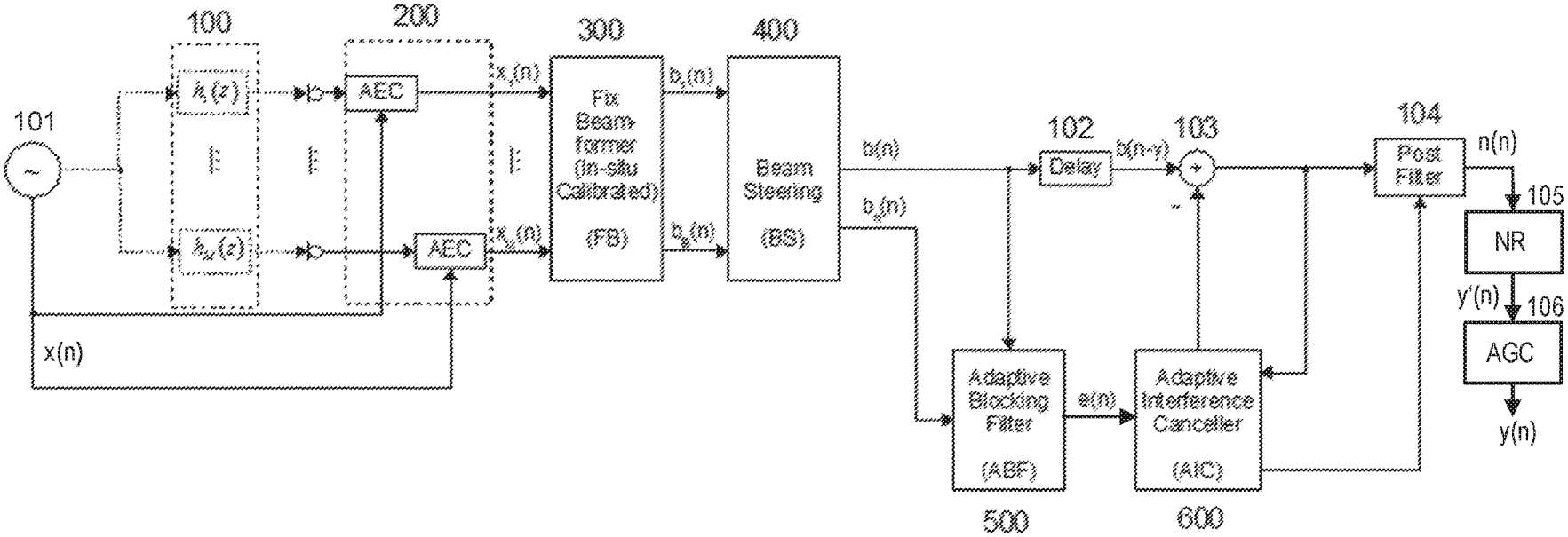
FIG. 1 is a schematic diagram illustrating an exemplary far field microphone system.

The Figures describe concepts in the context of one or more structural components. The various components shown in the figures can be implemented in any manner including, for example, software or firmware program code executed on appropriate hardware, hardware and any combination thereof. In some examples, the various components may reflect the use of corresponding components in an actual implementation. Certain components may be broken down into plural sub-components and certain components can be implemented in an order that differs from that which is illustrated herein, including a parallel manner.

DETAILED DESCRIPTION

It has been found that the desired signals and interfering signals often originate from different spatial locations. Therefore, beamforming techniques may be used to improve signal-to-noise ratio in audio applications. Common beamforming techniques include delay and sum techniques, adaptive finite impulse response (FIR) filtering techniques using algorithms such as the Griffiths-Jim algorithm, and techniques based on the modeling of the human binaural hearing system.

Beamformers can be classified as either data independent or statistically optimum, depending on how the weights are chosen. The weights in a data independent beamformer do not depend on the array data and are chosen to present a specified response for all signal/interference scenarios. Statistically optimum beamformers select the weights to optimize the beamformer response based on statistics of the data. The data statistics are often unknown and may change with time, so adaptive algorithms are used to obtain weights that converge to the statistically optimum solution. Computational considerations dictate the use of partially adaptive beamformers with arrays composed of large numbers of sensors. Many different approaches have been proposed for implementing optimum beamformers. In general, the statistically optimum beamformer places nulls in the directions of interfering sources in an attempt to maximize the signal to noise ratio at the beamformer output.

In many applications the desired signal may be of unknown strength and may not always be present. In such situations, the correct estimation of signal and noise covariance matrices in the maximum signal-to-noise ratio (SNR) is not possible. Lack of knowledge about the desired signal may impede utilization of the reference signal approach. These limitations may be overcome through the application of linear constraints to the weight vector. Use of linear constraints is a very general approach that permits extensive control over the adapted response of the beamformer. A universal linear constraint design approach does not exist and in many applications a combination of different types of constraint techniques may be effective. However, attempting to find either a single best way or a combination of different ways to design the linear constraint may limit the use of techniques that rely on linear constraint design for beamforming applications.

Generalized sidelobe canceller (GSC) technology presents an alternative formulation for addressing the drawbacks associated with the linear constraint design technique for beamforming applications. Essentially, GSC is a mechanism for changing a constrained minimization problem into unconstrained form. GSC leaves the desired signals from a certain direction undistorted, while, at the same time, undesired signals radiating from other directions are suppressed. However, GSC uses a two path structure; a desired signal path to realize a fix beamformer pointing to the direction of the desired signal, and an undesired signal path that adaptively generates an ideally pure noise estimate, which is subtracted from the output signal of the fix beamformer, thus increasing its signal-to-noise ratio (SNR) by suppressing noise.

The undesired signal path, i.e. the estimation of the noise, may be realized in a two-part approach. A first block of the undesired signal path is configured to remove or block remaining components of the desired signal from the input signals of this block, which is, e.g., an adaptive blocking filter in case of a single input, or an adaptive blocking matrix if more than one input signal is used. A second block of the undesired signal path may further comprise an adaptive (multi-channel) interference canceller (AIC) in order to generate a single-channel, estimated noise signal, which is then subtracted from the output signal of the desired signal path, e.g., an optionally time delayed output signal of the fix beamformer. Thus, the noise contained in the optionally time delayed output signal of the fix beamformer can be suppressed, leading to a better SNR, as the desired signal component ideally would not be affected by this processing. This holds true if and only if all desired signal components within the noise estimation could successfully be blocked, which is rarely the case in practice, and thus represents one of the major drawbacks related to current adaptive beamforming algorithms.

Acoustic echo cancellation can be achieved, e.g., by subtracting an estimated echo signal from the total sound signal. To provide an estimate of the actual echo signal, algorithms have been developed that operate in the time domain and that may employ adaptive digital filters that process time-discrete signals. Such adaptive digital filters operate in such a way that network parameters defining the transmission characteristics of the filter are optimized with reference to a preset quality function. Such a quality function is realized, for example, by minimizing the average square errors of the output signal of the adaptive network with reference to a reference signal.

Referring now to FIG. 1, in an exemplary far field sound capturing system, sound, which corresponds to a source signal x(n) with n being a (discrete) time index, from a desired sound source 101, is radiated via one or a plurality of loudspeakers (not shown), travels through a room (not shown), where it is filtered with the corresponding room impulse responses (RIRs) 100 represented by transfer functions $h_1(z) \ldots h_M(z)$, wherein z being a frequency index, and may eventually be corrupted by noise, before the resulting sound signals are picked up by M (M is an integer, e.g., 2, 3 or more) microphones which provide M microphone signals. The exemplary far field sound capturing system shown in FIG. 1 includes an acoustic echo cancellation (AEC) block 200 providing M echo canceled signals $x_1(n) \ldots x_M(n)$, a subsequent fix beamformer (FB) block 300 providing B (B is an integer, e.g., 1, 2 or more) beamformed signals $b_1(n) \ldots b_B(n)$, a subsequent beam steering block 400 which provides a desired-source beam signal b(n), also referred to herein as positive-beam output signal b(n), and, optionally, an undesired-source beamsignal $b_n(n)$, also referred to herein as negative-beam output signal $b_n(n)$. The blocks 100, 200, 300 and 400 are operatively coupled with each other to form at least one signal chain (signal path) between block 100 and block 400. An optional undesired signal (negative-beam) operatively coupled with the output of beam steering block 400 and supplied with the undesired-source beam signal $b_n(n)$ includes an optional adaptive blocking filter (ABF) block 500 and a subsequent adaptive interference canceller (AIC) block 600 operatively coupled with the ABF block 500. The ABF block 500 may provide an error signal e(n). Alternatively, the original M microphone signals or the M output signals of the AEC block 200 or the B output signals of the FB block 300 may be used as input signals to the ABF block 500, optionally overlaid with the undesired-source beam signal $b_n(n)$, to establish an optional multichannel adaptive blocking matrix (ABM) block as well as an optional multichannel AIC block.

A desired signal (positive-beam) path also operatively coupled with the beam steering block 400 and supplied with the desired-source beam signal b(n) includes a series-connection of an optional delay block 102, a subtractor block 103 and an (adaptive) post filter block 104. The adaptive post filter 104 receives an output signal of the subtractor block 103 and a control signal from AIC block 600. An optional speech pause detector (not shown) may be connected to and downstream of the adaptive post filter block 104 as well as a noise reduction (NR) block 105 and an optional automatic gain control (AGC) block 106, each of which, if present, may be connected upstream of the speech pause detector. It is noted that the AEC block 200, instead of being connected upstream of the FB block 300 as shown, may be connected downstream thereof, which may be beneficial if B<M, i.e., fewer beamformer blocks are available than microphones. Further, the AEC block 200 may be split into a multiplicity of sub-blocks (not shown), e.g., short-length sub-blocks for each microphone signal and a long-length sub-block (not shown) downstream of the BS block 400 for the desired-source beam signal and optionally another long-length sub-block (not shown) for the undesired-source beam signal. Further, the system is applicable not only in situations with only one source as shown but can be adapted for use in connection with a multiplicity of sources. For example, if stereo sources that provide two uncorrelated signals are employed, the AEC blocks may be substituted by stereo acoustic echo canceller (SAEC) blocks (not shown).

Figure 2:
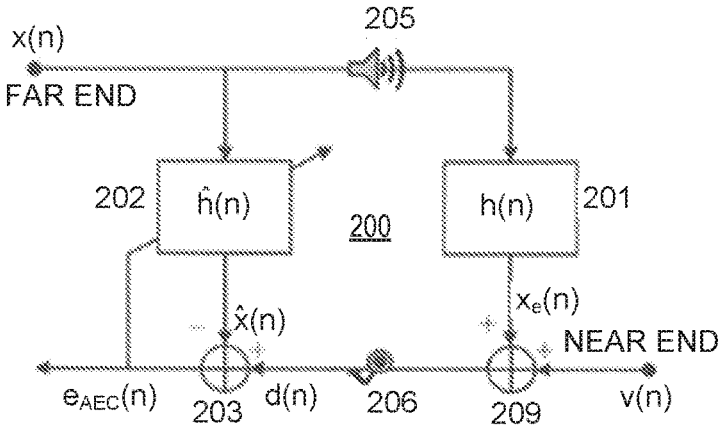
FIG. 2 is a schematic diagram illustrating an exemplary acoustic echo canceller applicable in the far field microphone system shown in FIG. 1.

As can be seen from FIG. 1, N (=1) source signals x(n), filtered by the N×M RIRs, and possibly interfered with by noise, serve as an input to the AEC blocks 200. FIG. 2 depicts an exemplary realization of a single microphone (206), single loudspeaker (205) AEC block 200. As would be understood and appreciated by those skilled in the art, such a configuration can be extended to include more than one microphone 206 and/or more than one loudspeaker 205. A far end signal, represented by the source signal x(n), travels via loudspeaker 205 through an echo path 201 having the transfer function (vector) $h(n)=(h_1, \ldots, h_M)$ to provide an echo signal $x_e(n)$. This signal is added at a summing node 209 to a near-end signal v(n) which may contain both background noise and near-end speech, resulting in an electrical microphone (output) signal d(n). An estimated echo signal $\hat{x}_e(n)$ provided by an adaptive filter block 202 is subtracted from the microphone signal d(n) at a subtracting node 203 to provide an error signal $e_{AEC}(n)$. The adaptive filter 202 is configured to minimize the error signal $e_{AEC}(n)$.

FIR filter 202 with transfer function $\hat{h}(n)$ of order L−1, wherein L is a length of the FIR filter, is used to model the echo path. The transfer function $\hat{h}(n)$ is given as $$[\hat{h}(0, n), \ldots \hat{h}(L-1, n),]^T$$

The desired microphone signal d(n) at block 203 for the adaptive filter is given as $$d(n)=x^T(n)h(n)+v(n),$$

wherein $x(n)=[x(n)x(n-1) \ldots x(n-L+1)]^T$ is a real-valued vector containing L (L is an integer) most recent time samples of the input signal, x(n), and v(n), i.e., the near-end signal with may include noise.

Using the previous notations, the feedback/echo error signal is given as $$e_{AEC}(n)=d(n)-x^T(n-1)\hat{h}(n)=x^T(n)[h(n)-\hat{h}(n)]+v(n),$$

wherein vectors h(n) and $\hat{h}(n)$ contain the filter coefficients representing the acoustical echo path and its estimation by the adaptive filter coefficients at time n. The cancellation filters $\hat{h}(n)$ are estimated using, e.g., a Least Mean Square (LMS) algorithm or any state-of the art recursive algorithm. The LMS update using a step size of μ(n) of the LMS-type algorithm can be expressed as $$\hat{h}(n)=\hat{h}(n-1)+\mu(n)x(n)e(n).$$

Figure 3:
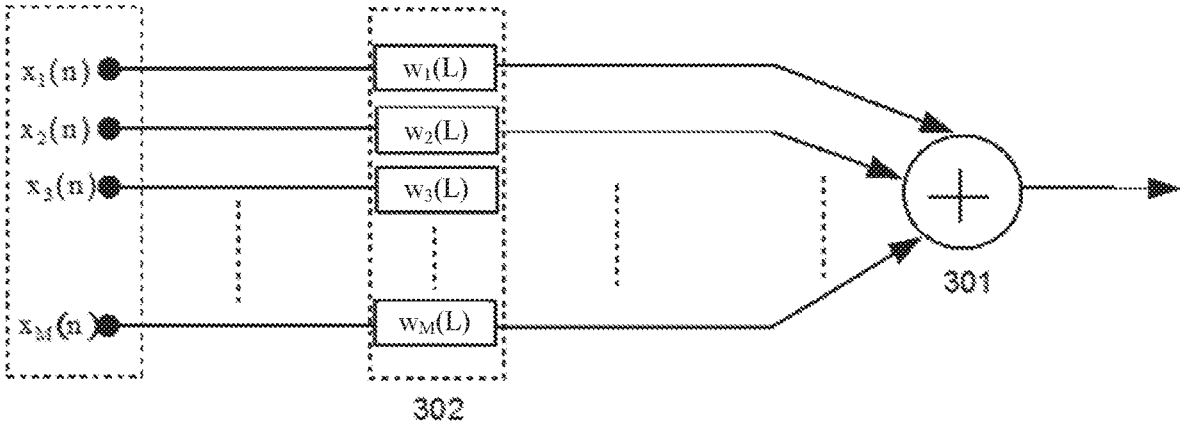
FIG. 3 is a schematic diagram illustrating an exemplary filter-and-sum beamformer.

A simple yet effective beamforming technique is the delay-and-sum (DS) technique. Referring again to FIG. 1, the outputs of AEC blocks 200 serve as inputs $x_i(n)$, with i=1, . . . , M, to the fix beamformer block 300. A general structure of a fix filter and sum (FS) beamformer block 300 including filter blocks 302 with at least one of transfer functions $w_i(L)$, i=1, . . . , M, and $w_i(L)=[w_i(0), \ldots, w_i(L-1)]$, L being the length of filters within the FB, is shown in FIG. 3. If the filter blocks 302 implement desired (factual) delays, the output beamformer signals $b_j(n)$ with j=1, . . . , B, are given as $$b_j(n) = \frac{1}{M}\sum_{i=1}^{M} x_i(n-\tau_{i,j}),$$

wherein M is the number of microphones and for each (fix) beamformer output signal $b_j(n)$ with j=1, . . . , B, each microphone has a delay $\tau_{i,j}$ relative to each other. The FS beamformer may include a summer 301 which receives the input signals $x_i(n)$ via filter blocks 302 having the transfer functions $w_i(L)$.

Referring again to FIG. 1, the beamformer signals $b_j(n)$ output by the fix FS beamformer block 300 serve as an input to the beam steering (BS) block 400. Each signal from the fix beamformer block 300 is taken from a different room direction and may have a different SNR level. The input signals $b_j(n)$ of the beam steering block 400 may contain low frequency components such as low frequency rumble, direct current (DC) offsets and unwanted vocal plosives in case of speech signals. These artifacts may impinge on the input signal $b_j(n)$ of the BS block 400 and should be removed.

Alternatively, the beam pointing to the undesired signal (e.g., noise) source, i.e. the undesired-signal beam, can be approximated based on the beam pointing to the desired sound source, i.e. the desired-signal beam, by letting it point to the opposite direction of the beam pointing to the desired sound source, which would result in a system using less resources and also in beams having exactly the same time variations. Further, this allows both beams to never point in the same direction.

As a further alternative, instead of just using the beam pointing to the desired-source direction (positive beam) a summation of this with its neighboring beams may be used as positive-beam output signal, since all of them contain a high level of desired signals, which are correlated to each other and would as such be amplified by the summation. On the other hand, noise parts contained in the three neighboring beams are uncorrelated to each other and will as such be suppressed by the summation. As a result, the final output signal of the three neighboring beams will improve SNR.

The beam pointing to the undesired-source direction (negative beam) can alternatively be generated by using all output signals of the FB block except the one representing the positive beam. This leads to an effective directional response having a spatial zero in the direction of the desired signal source. Otherwise, an omnidirectional character is applicable, which may be beneficial since noise usually enters the microphone array also in an omnidirectional way, and only rarely in a directional form.

Further, the optionally delayed, desired signal from the BS block may form the basis for the output signal and as such is input into the optional adaptive post filter. The adaptive post filter, which is controlled by the AIC block and which delivers a filtered output signal, can optionally be input into a subsequent single channel noise reduction block (e.g., NR block 105 in FIG. 1), which may implement the known spectral subtraction method, and an optional (e.g., final) automatic gain control block (e.g., AGC block 106 in FIG. 1).

Figure 4:
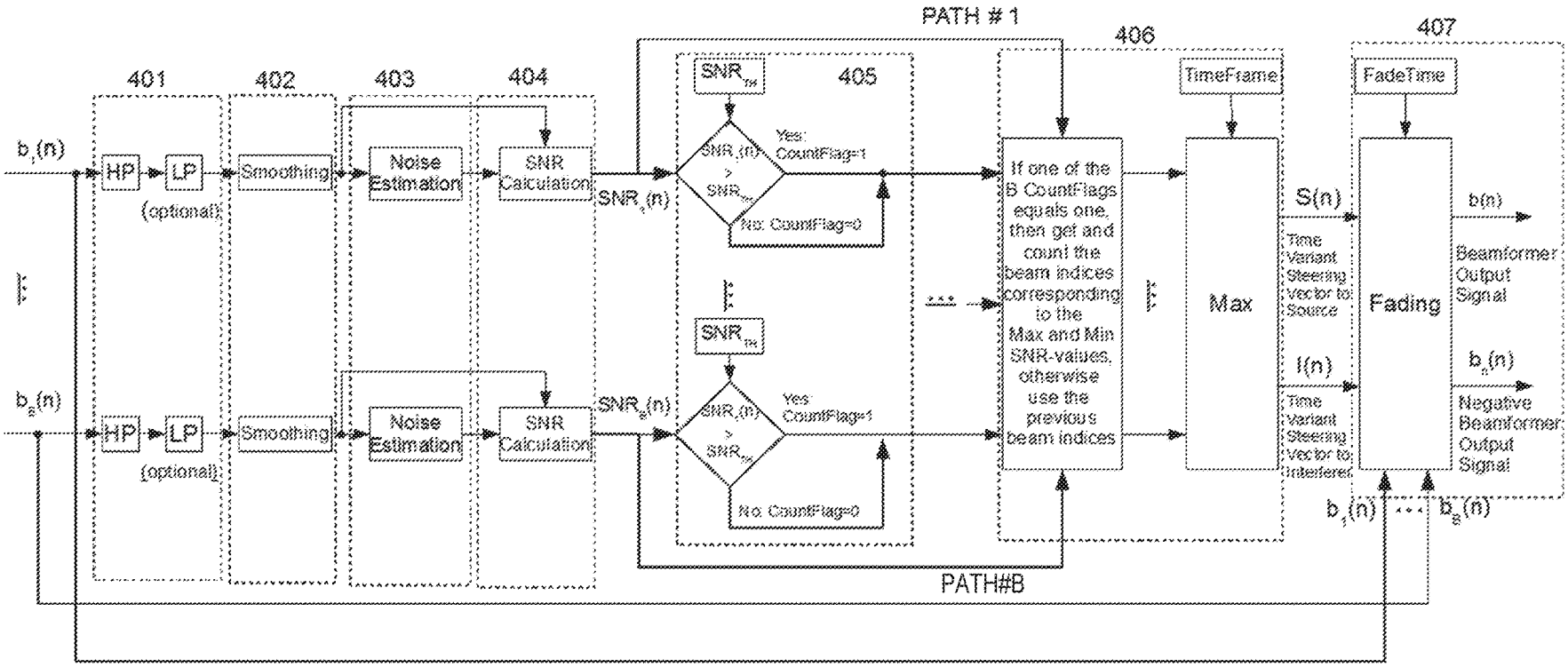
FIG. 4 is a schematic diagram illustrating an exemplary beam steering block.

Referring to FIG. 4, in beam steering block 400 its input signals $b_j(n)$ are filtered using a high pass (HP) filter and an optional low pass (LP) filter block 401 in order to block signal components that are either affected by noise or do not contain useful signal components, e.g., certain speech signal components. The output from filter block 401 may have amplitude variations due to noise that may introduce rapid, random changes in amplitude from point to point within the signal $b_j(n)$. In this situation, it may be useful to reduce noise, e.g., in a smoothing block 402 shown in FIG. 4.

The filtered signal from filter block 401 is smoothed by applying, e.g., a low pass infinite impulse response (IIR) filter or an moving average (MA) finite impulse response (FIR) filter (both not shown) in smoothing block 402, thereby reducing the high frequency components and passing the low-frequency components with little change. The smoothing block 402 outputs a smoothed signal that may still contain some level of noise and thus, may cause noticeable sharp discontinuities as described above. The level of voice signals typically differs distinctly from the variation of the level of background noise, particularly due to the fact that the dynamic range of a level change of voice signals is greater and occurs in much shorter intervals than a level change of background noise. A linear smoothing filter in a noise estimation block 403 would therefore smear out the sharp variation in the desired signal, e.g., music or voice signal, as well as filter out the noise. Such smearing of a music or voice signal is unacceptable in many applications, therefore a non-linear smoothing filter (not shown) may be applied to the smoothed signal in noise estimation block 403 to overcome the artifacts mentioned above. The data points in output signal $b_j(n)$ of smoothing block 402 are modified in a way that individual points that are higher than the immediately adjacent points (presumably because of noise) are reduced, and points that are lower than the adjacent points are increased. This leads to a smoother signal (and a slower step response to signal changes).

Next, based on the smoothed signal from smoothing block 402 and the estimated background noise signal from noise estimation block 403, the variations in the SNR value are calculated. Using variations in the SNR, a noise source can be differentiated from a desired speech or music signal. For example, a low SNR value may represent a variety of noise sources such as an air-conditioner, a fan, an open window, or an electrical device such as a computer etc. The SNR may be evaluated in a time domain or in a frequency domain or in a sub-band frequency domain.

In a comparator block 405, the output SNR value from block 404 is compared to a pre-determined threshold. If the current SNR value is greater than a pre-determined threshold, a flag indicating, e.g., a desired speech signal will be set to, e.g., '1'. Alternatively, if the current SNR value is less than a pre-determined threshold, a flag indicating an undesired signal such as noise from an air-conditioner, fan, an open window, or an electrical device such as a computer will be set to '0'.

SNR values from blocks 404 and 405 are passed to a controller block 406 via paths #1 to path #B. A controller block 406 compares the indices of a plurality of SNR (both low and high) values collected over time against the status flag in comparator block 405. A histogram of the maximum and minimum values is collected for a pre-determined time period. The minimum and maximum values in a histogram are representative of at least two different output signals. At least one signal is directed towards a desired source denoted by S(n) and at least one signal is directed towards an interference source denoted by I(n).

If the indices for low and high SNR values in controller block 406 change over time, a fading process is initiated that allows a smooth transition from one to the other output signal, without generating acoustic artifacts. The outputs of the BS block 400 represent desired-signal and optionally undesired-signal beams selected over time. Here, the desired-signal beam represents the fix beamformer output b(n) having the highest SNR. The optional undesired beam represents a fix beamformer output $b_n(n)$ having the lowest SNR.

The outputs of BS block 400 contain a signal with a high SNR (positive beam) which can be used as a reference by the optional adaptive blocking filter (ABF) block 500 and an optional one with a low SNR (negative beam), forming a second input signal for the optional ABF block 500. The ABF filter block 500 may use least mean square (LMS) algorithm controlled filters to adaptively subtract the signal of interest, represented by the reference signal b(n) (representing the desired-source beam) from the signal $b_n(n)$ (representing the undesired-source beam) and provides error signal(s) $e_+(n)$. Error signal(s) $e_+(n)$ obtained from ABF block 500 is/are passed to the adaptive interference canceller (AIC) block 600 which adaptively removes the signal components that are correlated to the error signals from the beamformer output of the fix beamformer 300 in the desired-signal path. As already mentioned, other signals can alternatively or additionally serve as input to the ABM block. However, the adaptive beamformer block including optional ABM, AIC and APF blocks can be partly or totally omitted.

First, AIC block 600 computes an interference signal using an adaptive filter (not shown). Then, the output of this adaptive filter is subtracted from the optionally delayed (with delay 102) reference signal b(n), e.g., by a subtractor block 103 to eliminate the remaining interference and noise components in the reference signal b(n). Finally, an adaptive post filter 104 may be disposed downstream of subtractor block 103 for the reduction of statistical noise components (not having a distinct autocorrelation). As in the ABF block 500, the filter coefficients in the AIC block 600 may be updated using the adaptive LMS algorithm. The norm of the filter coefficients in at least one of AIC block 600, ABF block 500 and AEC blocks may be constrained to prevent them from growing excessively large.

Figure 5:
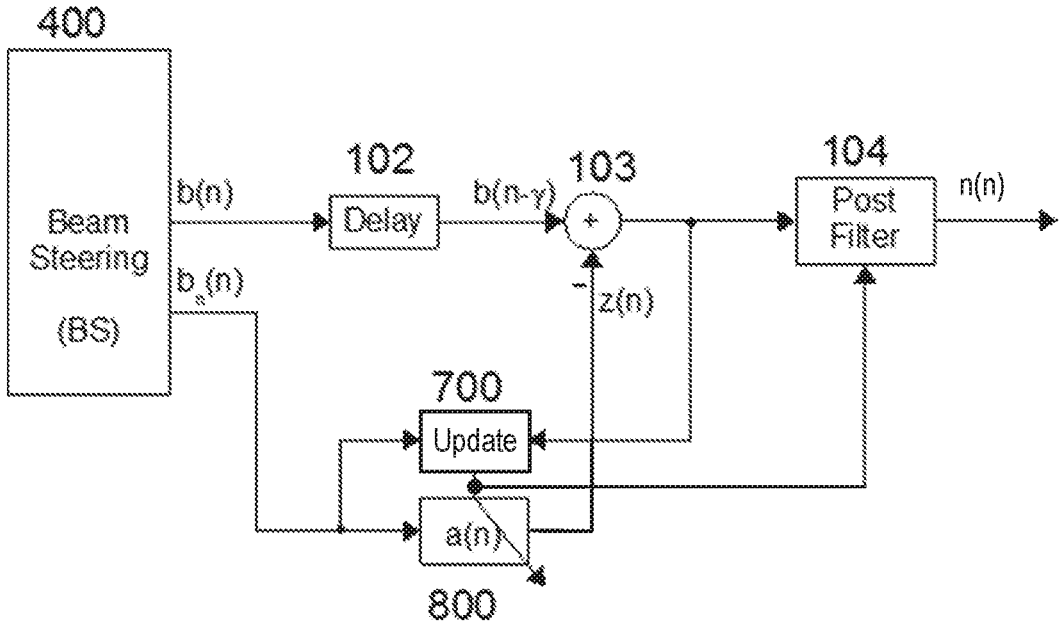
FIG. 5 is a schematic diagram illustrating a simplified structure of an exemplary adaptive interference canceler with adaptive post filter and without an adaptive blocking filter.

FIG. 5 illustrates an exemplary system for eliminating noise from the desired-source beam (positive beam) signal b(n). Thereby, the noise component included in the signal b(n), which is represented by signal z(n) in FIG. 5, is provided by an adaptive system, which includes a filter control block 700 that controls by way of a filter control signal a controllable filter 800. The signal b(n) is subtracted by way of the subtractor block 103 from the desired signal b(n), optionally after being delayed in a delay block 102 as a delayed desired signal $b(n-\gamma)$, to provide an adder output signal containing, to a certain extent, reduced undesired noise. The signal $b_n(n)$, which represents the undesired-signal beam and ideally only contains noise and no useful signal such as speech, is used as a reference signal for the filter control block 700 which also receives as an input the adder output signal. The known normalized least mean square (NLMS) algorithm may be used to filter noise out from the desired signal b(n) provided by BS block 400. The noise component in the desired signal b(n) is estimated by the adaptive system including filter control block 700 and controllable filter 800. Controllable filter 800 filters the undesired signal $b_n(n)$ under control of filter control block 700 to provide an estimate of the noise contained in the desired signal b(n), which is subtracted from the (optionally) delayed desired signal $b(n-\gamma)$ in subtractor block 103 to reduce further noise in the desired signal b(n). This will in turn increase the signal-to-noise (SNR) ratio of the desired signal b(n). The filter control signal from filter control block 700 is further used to control the adaptive post filter 104. The system shown in FIG. 5 employs no optional ABF or ABM block since an additional blocking of signal components of the undesired signal, performed by the ABF or ABM block, may be omitted if it has little effect in increasing the quality of the pure noise signal in comparison to the desired signal. Thus, it may be reasonable to omit the ABF or ABM block without deteriorating the performance of the adaptive beamformer dependent on the quality of the undesired signal $b_n(n)$.

Referring again to FIG. 1, an output signal from the APF block 104 may form an input signal n(n) into the NR block 105. An exemplary NR block that is applicable as NR block 105 or can be applied to any other application or used as autonomous system is described below in connection with FIG. 6. In the NR block shown in FIG. 6, the input signal n(n) is supplied to a spectral transformation block 601, in which it is transformed from the time domain into the spectral domain, i.e., into a spectral input signal N(ω), e.g., by way of a fast Fourier transformation (FFT). The spectral input signal N(ω) is supplied to an optional spectral smoothing block 602 for spectral smoothing. Depending on whether the optional spectral smoothing block 602 is present or not, a subsequent temporal smoothing block 603 is connected to the optional spectral smoothing block 602 (as shown) or to the spectral transformation block 601 (not shown). Smoothing a signal may include filtering the signal to capture important patterns in the signal, while leaving out noisy, fine-scale and/or rapid changing patterns.

A background noise estimation block 604 is connected to and downstream of the temporal smoothing block 603 and may utilize any known method that allows for determining or estimating the background noise contained in the input signal n(n). In the example shown, the signal to be evaluated, spectral input signal N(ω), is in the spectral domain so that the background noise estimation block 604 is designed to operate in the spectral domain.

In a spectral signal-to-noise ratio determination (calculation) block 605 connected to and downstream of the background noise estimation block 604, the signals input into and the signals output by the background noise estimation block 604 are processed to provide a spectral signal-to-noise ratio SNR(ω). For example, the spectral signal-to-noise ratio determination block 605 may divide the signal input into the background noise estimation block 604 by the signal output by the background noise estimation block 604 to determine the spectral signal-to-noise ratio SNR(ω).

In a first evaluation block 606 connected to and downstream of the spectral signal-to-noise ratio determination block 605, the estimated signal-to-noise ratio SNR(ω) in the spectral domain is compared (e.g., within a predetermined frequency band) to a predetermined signal-to-noise ratio threshold $SNR_{TH}$. If the estimated signal-to-noise ratio SNR(ω) exceeds the signal-to-noise ratio threshold $SNR_{TH}$, a weighting mask I(ω) output by the first evaluation block 606 is set to a predetermined maximum signal-to-noise ratio value, e.g., an overestimation factor MaxSnrTh. Otherwise, the weighting mask I(ω) may be set to a constant value, e.g., one. The first evaluation block 606 further outputs a signal-to-noise ratio mask SnrMask(ω) which is derived from the estimated signal-to-noise ratio SNR(ω) by dividing the estimated signal-to-noise ratio SNR(ω) by the signal-to-noise ratio threshold $SNR_{TH}$.

In a noise blocking block 607 connected to and downstream of the first evaluation block 606, the SNR driven mask, which is here the signal-to-noise ratio mask SnrMask(ω) from the first evaluation block 606, is modified, e.g., by multiplying the signal-to-noise ratio mask SnrMask(ω) with the weighting mask I(ω) from the first evaluation block 606 to generate a once modified SNR mask SnrMask'(ω).

In an optional second evaluation block 608 connected to and downstream of the noise blocking block 607, the modified SNR mask SnrMask'(ω) is compared to a minimum threshold $MIN_{TH}$. If the modified SNR mask SnrMask'(ω) exceeds the minimum threshold $MIN_{TH}$, a twice modified SNR mask SnrMask"(ω) is set to the minimum threshold $MIN_{TH}$, otherwise the once modified SNR mask SnrMask'(ω) is output as the twice modified SNR mask SnrMask"(ω).

In a third evaluation block 609 connected to and downstream of the second evaluation block 608, a p-norm of the twice modified SNR mask SnrMask"(ω) is taken to generate a triply modified (final) SNR mask SnrMask'"(ω). The triply modified SNR mask SnrMask'"(ω) is applied as a noise blocking mask to the spectral input signal N(ω) in a mask application block 610 which is connected to and downstream of blocks 601 and 609. In the mask application block 610, the triply modified SNR mask SnrMask'"(ω) may be multiplied with the spectral input signal N(ω) to provide a spectral output signal Y(ω). The spectral output signal Y(ω) is supplied to a subsequent spectral transformation block 611 where it is transformed back from the frequency domain into the time domain, i.e., into a time domain input signal y(n), e.g., by way of an inverse fast Fourier transformation (IFFT).

Figure 6:
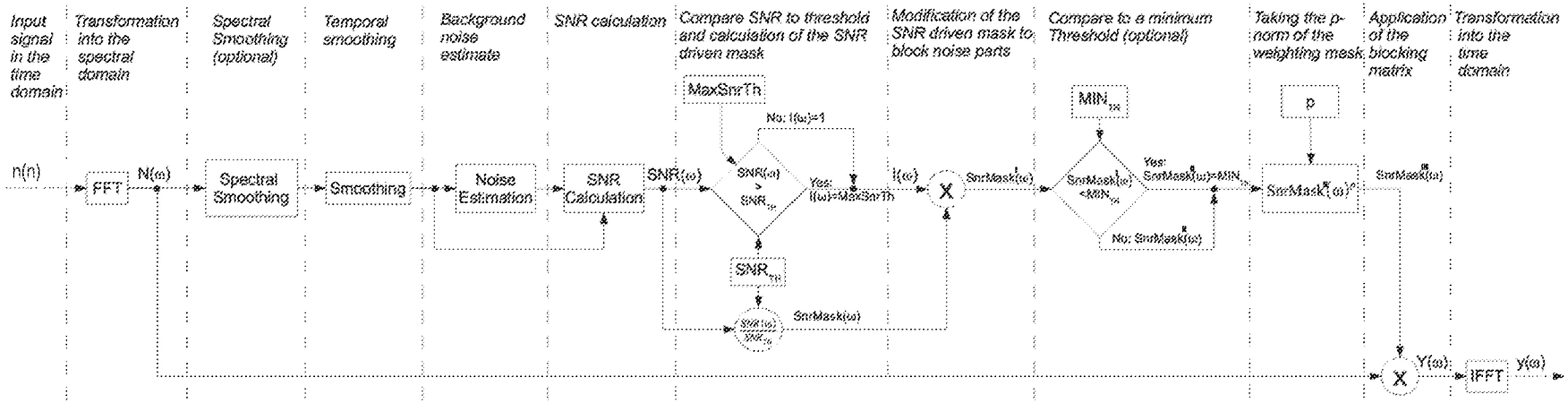
FIG. 6 is a schematic diagram of an exemplary single channel noise reduction system.

In the first blocks of the single channel noise reduction system shown in FIG. 6, the SNR in the frequency domain, the spectral SNR, is estimated, and is then compared to the predetermined SNR threshold $SNR_{TH}$. Dependent on the result of this comparison, the weighting mask I(ω) is generated whose values may be set to the neutral weight of one if the current spectral SNR(ω) does not exceed the given SNR threshold $SNR_{TH}$. Otherwise, the weighting mask I(ω) may be set to the (adjustable) overestimation factor MaxSnrTh which may be greater than or equal to one, i.e. MaxSnrTh≥0[dB]. In a side path, the currently estimated, spectral SNR values SNR(ω) may be scaled by the given SNR threshold $SNR_{TH}$, which delivers the desired mask $$SnrMask(\omega) = \frac{SNR(\omega)}{10^{\frac{SNR_{TH}[dB]}{20}}}.$$

Successively the mask will be multiplied with the weights of weighting mask I(ω) to a once modified spectral SNR mask SnrMask'(ω) thereof, i.e., $$SnrMask'(\omega) = SnrMask(\omega) \cdot 10^{\frac{I(\omega)[dB]}{20}}.$$

Thus, a spectral weighting mask is generated that contains overestimation values of spectral parts. The spectral parts of this spectral weighting mask include speech signals indicated by the spectral SNR values SNR(ω) exceeding the given SNR threshold $SNR_{TH}$ as well as SNR driven spectral weights known, e.g., from spectral subtraction and able to suppress spectral parts below the given SNR threshold $SNR_{TH}$. The size of the weights is directly dependent on the current spectral SNR values SNR(ω) as well as on the given SNR threshold $SNR_{TH}$. The spectral SNR values SNR(ω) that are equal to the given threshold $SNR_{TH}$ result in mask values of SnrMask'(ω)=1. Mask values of once modified spectral SNR mask SnrMask'(ω)<1 are generated if $$SNR(\omega) < 10^{\frac{SNR_{TH}[dB]}{20}},$$

and mask values of once modified spectral SNR mask $$SnrMask'(\omega) = 10^{\frac{MaxSnrTh[dB]}{20}} \text{ if } SNR(\omega) > 10^{\frac{SNR_{TH}[dB]}{20}}.$$

In an optional subsequent block, the SNR based, once modified spectral SNR mask SnrMask'(ω) can also be limited to a tunable, minimal threshold $MIN_{TH}$. This means that, if the current spectral mask $$SnrMask(\omega) < 10^{\frac{MinSnrTh[dB]}{20}},$$

the SNR based, once modified spectral SNR mask SnrMask'(ω) will be limited to this given minimum threshold, i.e. it will be set to $$SnrMask'(\omega) = 10^{\frac{MinSnrTh[dB]}{20}},$$

so that a maximum noise reduction of $MIN_{TH}$ can be achieved.

In the subsequent block, the p-norm of the current, once modified spectral SNR mask SnrMask'(ω) is calculated to provide a triple modified (final) SNR mask SnrMask'''(ω)=(SnrMask''(ω))$^p$. For example, a p-factor of p=½ may be employed, which equals taking the square root of the twice modified spectral SNR mask SnrMask''(ω) or the once modified spectral SNR mask SnrMask'(ω). The SNR threshold $SNR_{TH}$ may be adjusted dependent on the chosen p-factor. For example, if a p-factor of p=½ is taken, a SNR threshold of $SNR_{TH}$=30[dB] or, if a p-factor of p=1 is applied, a SNR threshold of $SNR_{TH}$=15[dB] may be utilized. Further, the SNR threshold value of $SNR_{TH}$=15 [dB] in connection with a p-factor p=1 may be divided by a p-factor other than p=1. Hence, if a p-factor of p=½ is selected, a SNR threshold of $SNR_{TH}$=15[dB], p=15[dB]$^{1/2}$=30 [dB] would result.

In a further block, the triple modified spectral SNR mask SnrMask'''(ω) will be applied to the spectral input signal X(ω), resulting in the spectral output signal Y(ω)=SnrMask'''(ω)·X(ω), which will then be transformed into the time domain, e.g., utilizing an overlap safe process.

To allow for overestimation but avoid an unsteady behavior of the mask in case of overestimation, an alternative approach may be applied. The p-norm may be applied to the (once or) twice modified SNR mask SnrMask''(ω) if the modified mask's weights undercut one, which can be considered as a "normal noise reduction case", so that, for example, SnrMask'''(ω)=(SnrMask''(ω))$^p$ for spectral signal-to-noise ratios BandSnr<$SNR_{TH}$. However, a different p-mask may be applied to the (once or) twice modified SNR mask SnrMask''(ω) if weights of the modified mask exceed one, which can be considered as an "overestimation case", so that, for example, SnrMask'''(ω)=(SnrMask''(ω))$^{poec}$ for spectral signal-to-noise ratios BandSnr>$SNR_{TH}$, in which poec is a p-norm other than p. Further, in the "overestimation case" the (modified) SNR mask may be limited to a maximum threshold MaxSnrTh according to $$SnrMask'(\omega) = 10^{\frac{MaxSnrTh[dB]}{20}}$$

for SnrMask'(ω)>MaxSnrTh. In the cases outlined above the p-norm p may be ½ or 1 and the p-norm poec may be √2 or 2.

Tests showed that, if having an APF block added at the end of the ABF block, a single-channel noise reduction is able to further enhance the overall performance of the underlying far-field sound capturing system. This holds also true if one wants to further increase speech intelligibility, e.g., to improve the recognition rate of a speech recognition engine, particularly in adverse situations, e.g., in low SNR situations when the background noise is high compared to the speech signal.

The NR block may be put at the end of the signal processing chain but does not need to be connected downstream of the ABF block, since the order as well as the presence of some or all the signal processing blocks utilized in the system shown in FIG. 1 can be freely chosen. As an example, the ABF block may be completely omitted so that the BS block may only deliver the positive beam output signal, which may be input into the NR block. In another example, instead of the FB block only a (single) modal beamformer may be utilized, and also the BS block may be omitted so that the signal output by the FB block may be input to the NR block etc. Here, the FB block may contain a modal beamformer that automatically steers its look direction to the desired speech source (e.g., a talker). The simple and effective single-channel noise reduction system and method disclosed herein is based on spectral subtraction in which a Wiener filter is calculated based on the currently estimated SNR.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

The embodiments of the present disclosure generally provide for a plurality of circuits, electrical devices, and/or at least one controller. All references to the circuits, the at least one controller, and other electrical devices and the functionality provided by each, are not intended to be limited to encompassing only what is illustrated and described herein. While particular labels may be assigned to the various circuit(s), controller(s) and other electrical devices disclosed, such labels are not intended to limit the scope of operation for the various circuit(s), controller(s) and other electrical devices. Such circuit(s), controller(s) and other electrical devices may be combined with each other and/or separated in any manner based on the particular type of electrical implementation that is desired.

A block is understood to be a hardware system or an element thereof with at least one of: a processing unit executing software and a dedicated circuit structure for implementing a respective desired signal transferring or processing function. Thus, parts or all of the system may be implemented as software and firmware executed by a processor or a programmable digital circuit. It is recognized that any system as disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any system as disclosed may utilize any one or more microprocessors to execute a computer-program that is embodied in a non-transitory computer readable medium that is programmed to perform any number of the functions as disclosed. Further, any controller as provided herein includes a housing and a various number of microprocessors, integrated circuits, and memory devices, (e.g., FLASH, random access memory (RAM), read only memory (ROM), electrically programmable read only memory (EPROM), and/or electrically erasable programmable read only memory (EEPROM).

While various embodiments of the invention have been described, it will be apparent to those of ordinary skilled in the art that many more embodiments and implementations are possible within the scope of the invention. In particular, the skilled person will recognize the interchangeability of various features from different embodiments. Although these techniques and systems have been disclosed in the context of certain embodiments and examples, it will be understood that these techniques and systems may be extended beyond the specifically disclosed embodiments to other embodiments and/or uses and obvious modifications thereof.

What is claimed is:

1. A noise reduction system, comprising:

a detector block configured to detect noise components in an input signal to generate a signal-to-noise ratio spectrum of the input signal; and a masking block operatively coupled to the detector block and configured to generate a final spectral noise removal mask and to apply the final spectral noise removal mask to the input signal if noise components in the input signal are detected, the final spectral noise removal mask being configured to suppress the noise components in the input signal, when applied, wherein the masking block comprises:

a first evaluation block configured to generate from the signal-to-noise ratio spectrum of the input signal a basic spectral noise removal mask, the first evaluation block further configured to compare the signal-to-noise ratio spectrum of the input signal to a predetermined signal-to-noise ratio threshold and to provide a weighting mask dependent on results of the comparison, a mask modification block configured to modify the basic spectral noise removal mask dependent on the weighting mask to provide a once-modified spectral noise removal mask, and a second evaluation block that is configured to compare the once-modified spectral noise removal mask to a minimum threshold and to provide a twice-modified spectral noise removal mask dependent on the results of the comparison.

2. The system of claim 1, wherein the detector block comprises a signal-to-noise ratio determination block that is configured to determine the signal-to-noise ratio spectrum of the input signal by determining signal-to-noise ratios per discrete frequency of the input signal.

3. The system of claim 1, wherein the second evaluation block is further configured to set the twice-modified spectral noise removal mask to a predetermined minimum value if the signal-to-noise ratio spectrum is below the minimum threshold, and otherwise to the once-modified spectral noise removal mask.

4. The system of claim 1, wherein the masking block further comprises a third evaluation block that is configured to apply a p-norm to the once-modified spectral noise removal mask or the twice-modified spectral noise removal mask.

5. The system of claim 1, wherein the first evaluation block is further configured to set the weighting mask to a predetermined maximum signal-to-noise ratio value if the signal-to-noise ratio spectrum exceeds the signal-to-noise ratio threshold, and otherwise to a predetermined constant value.

6. A computer-implemented method for reducing noise, the method comprising:

detecting noise components in an input signal to generate a signal-to-noise ratio spectrum of the input signal;

scaling the signal-to-noise ratio spectrum by an adjustable signal-to-noise threshold; and subsequent to scaling the signal-to-noise ratio spectrum, generating a final spectral noise removal mask and applying the final spectral noise removal mask to the input signal if noise components in the input signal are detected, the final spectral noise removal mask being configured to suppress the noise components in the input signal, when applied.

7. The method of claim 6, wherein detecting noise components comprises determining the signal-to-noise ratio spectrum of the input signal by determining signal-to-noise ratios per discrete frequency of the input signal.

8. The method of claim 6, wherein generating the final spectral noise removal mask comprises:

generating from the signal-to-noise ratio spectrum of the input signal a basic spectral noise removal mask, comparing the signal-to-noise ratio spectrum of the input signal to a predetermined signal-to-noise ratio threshold, and providing a weighting mask dependent on results of the comparison; and modifying the basic spectral noise removal mask dependent on the weighting mask to provide a once-modified spectral noise removal mask.

9. The method of claim 8, wherein generating the final spectral noise removal mask comprises comparing the once-modified spectral noise removal mask to a minimum threshold and providing a twice-modified spectral noise removal mask dependent on the results of the comparison.

10. The method of claim 9, wherein providing a twice-modified spectral noise removal mask dependent on the results of the comparison comprises setting the twice-modified spectral noise removal mask to a predetermined minimum value if the signal-to-noise ratio spectrum is below the minimum threshold, and otherwise to the once-modified spectral noise removal mask.

11. The method of claim 9, wherein generating the final spectral noise removal mask comprises applying a p-norm to the once-modified spectral noise removal mask or the twice-modified spectral noise removal mask.

12. The method of claims 8, wherein providing the weighting mask dependent on the results of the comparison comprises setting the weighting mask to a predetermined maximum signal-to-noise ratio value if the signal-to-noise ratio spectrum exceeds the signal-to-noise ratio threshold, and otherwise to a predetermined constant value.

13. One or more non-transitory computer-readable media including instructions that, when executed by one or more processors, cause the one or more processors to perform steps of:

detecting noise components in an input signal to generate a signal-to-noise ratio spectrum of the input signal;

scaling the signal-to-noise ratio spectrum by an adjustable signal-to-noise threshold; and subsequent to scaling the signal-to-noise ratio spectrum, generating a final spectral noise removal mask and applying the final spectral noise removal mask to the input signal if noise components in the input signal are detected, the final spectral noise removal mask being configured to suppress the noise components in the input signal, when applied.

* * * * *